United States Patent [19]

Brundige, Jr.

[11] 4,456,459

[45] Jun. 26, 1984

[54] ARRANGEMENT AND METHOD FOR THE PRODUCTION OF LIQUID NATURAL GAS

[75] Inventor: Virgil L. Brundige, Jr., Grand Prairie, Tex.

[73] Assignee: Mobil Oil Corporation, New York, N.Y.

[21] Appl. No.: 456,234

[22] Filed: Jan. 7, 1983

[51] Int. Cl.[3] ..... F25J 3/02

[52] U.S. Cl. ..... 62/9; 62/38

[58] Field of Search ..... 62/9, 11, 38, 39, 36, 62/45, 52, 54, 55

[56] References Cited

U.S. PATENT DOCUMENTS

| | | | |
|---|---|---|---|
| 3,182,461 | 5/1965 | Johanson | 62/13 |
| 3,203,191 | 8/1965 | French | 62/9 |
| 3,292,380 | 12/1966 | Bucklin | 62/20 |
| 3,383,873 | 5/1968 | Becker | 62/11 |
| 3,416,324 | 12/1968 | Swearingen | 62/23 |
| 3,616,652 | 11/1971 | Engel | 62/11 |
| 3,702,541 | 11/1972 | Randall et al. | 62/26 |
| 3,724,226 | 4/1973 | Pachaly | 62/39 |
| 3,729,944 | 5/1973 | Kelly et al. | 62/39 |
| 3,735,600 | 5/1973 | Dowdell et al. | 62/39 |
| 3,864,926 | 2/1975 | Collins | 62/38 |
| 4,061,481 | 12/1977 | Campbell et al. | 62/29 |
| 4,065,278 | 12/1977 | Newton et al. | 62/26 |
| 4,155,729 | 5/1979 | Gray et al. | 62/18 |
| 4,179,897 | 12/1979 | Hvizdos et al. | 62/9 |
| 4,334,902 | 6/1982 | Paradowski | 62/9 |

*Primary Examiner*—Frank Sever

*Attorney, Agent, or Firm*—A. J. McKillop; M. G. Gilman; J. F. Powers, Jr.

[57] ABSTRACT

An arrangement and a method for the increase in the production of liquid natural gas and the conservation of energy and reduction of flash gas in a liquid natural gas manufacturing installation and, more particularly, the reduction in the quantity of formed flash gas through the novel utilization of a hydraulic expander in the installation for extracting work from the flow of liquid natural gas prior to flashing thereof.

10 Claims, 1 Drawing Figure

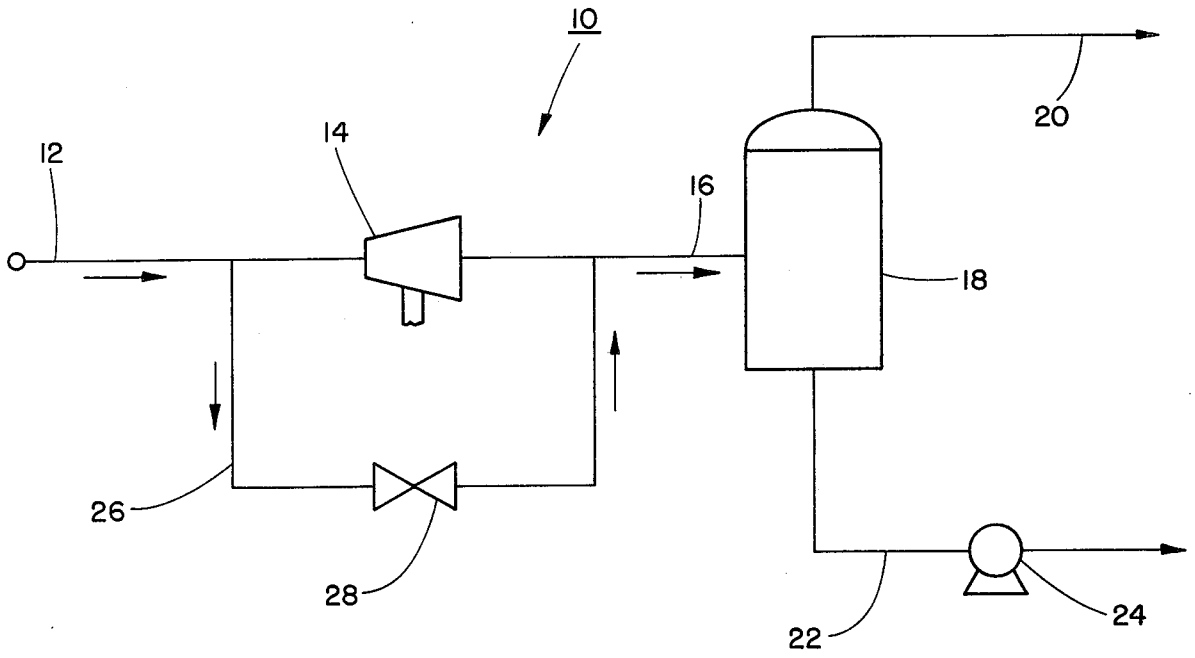
10
12
14
16
18
20
22
24
26
28

ARRANGEMENT AND METHOD FOR THE PRODUCTION OF LIQUID NATURAL GAS

BACKGROUND OF THE INVENTION

1. Field of the Invention

The present invention relates to an arrangement and to a method for the increase in the production of liquid natural gas and the conservation of energy and reduction of flash gas in a liquid natural gas manufacturing installation and, more particularly, relates to the reduction in the quantity of formed flash gas through the novel utilization of a hydraulic expander in the installation for extracting work from the flow of liquid natural gas prior to flashing thereof.

2. Discussion of the Prior Art

In liquid natural gas manufacturing facilities wherein liquid natural gas is conveyed from the manufacturing facility to a storage location subsequent to being flashed in a low pressure flash, a continuous stream of the liquid natural gas is conducted, as is well known in the technology, from the main exchanger of the liquid natural gas manufacturing facility through either a Joule-Thomson valve or a reversely operating pump which removes work from the flow, to a low-pressure flash in which the effluent from the Joule-Thomson valve or the reversely operating pump is divided into a first flow consisting of liquid natural gas which is conducted through the intermediary of a suitable transfer pump to a storage facility, and into a flow of natural gas vapor or flash gas which is adapted to be employed as fuel within the operating facility or plant.

Basically, the Joule-Thomson valve or reversely operating pump operate on the liquid natural gas stream flowing from the main exchanger of the liquid natural gas manufacturing facility at a very low temperature, thereby extensively reducing the temperature and pressure of the liquid flow, and wherein the extracted work using the reversely operating pump may be employed within the facility when converted into mechanical or electrical energy through suitable shaft-coupled compressors, pumps or generators in order to power other installation or plant components. Thus, the energy state change through the Joule-Thomson valve or the work recovered by the reversely operating pump, although relatively small in quantity, significantly enhances the production of liquid natural gas when flashed while producing a lower volume of flash gas or natural gas vapor, thereby improving the economical operation of the manufacturing facility. Although the utilization of Joule-Thomson valves and reversely operating pumps which extract work, such as centrifugal pumps or the like, in liquid gas manufacturing facilities result in an energy state change or the extraction of work from liquid streams under pressure, such as a cryogenic processing system for liquid natural gas which is conducted under high pressures and extremely low temperatures from the main exchanger of a liquid natural gas manufacturing facility, the energy state change or the work extracted has, generally, not been adequate to provide a degree of reduction in flash gas or natural gas vapor subsequent to flashing in a low pressure flash to a level of flash gas which will conform to the gas fuel requirements within the facility. Consequently, there is encountered an appreciable excess or waste of natural gases, with a concommitant reduction in the production of processed liquid natural gas, in which the economic production potential of the liquid natural gas manufacturing facility is not fully realized.

SUMMARY OF THE INVENTION

Accordingly, in order to improve upon the economics in the liquid natural gas production of a liquid natural gas manufacturing facility pursuant to the present invention, in order to reduce the quantity of flash gas and to resultingly increase the yield of liquid natural gas, there is provided the intermediary of a more efficient arrangement and method of extracting work from a flow of liquid natural gas at extremely low temperatures within a hydraulic expander. As a result, the effluent from the hydraulic expander when flashed in a low-pressure flash will produce a higher yield of liquid natural gas and, consequently, a lower proportion of flash gas, with an additional conservation of energy. For extracting work from the flow of liquid natural gas, there is contemplated the utilization of a hydraulic expander in lieu of a Joule-Thomson valve or reversely operating pump in the installation. The work extracted by the hydraulic expander may be usefully employed in the facility to operate various power-driven components through suitable shaft-coupled compressors, pumps or generators.

In a particularly advantageous embodiment of an arrangement pursuant to the present invention, a Joule-Thomson valve is interposed in a flow conduit in parallel bypass relationship with the conduit incorporating the inventive hydraulic expander and, in essence, is positioned intermediate a main exchanger of the liquid natural gas production facility and the low-pressure flash. The Joule-Thomson valve is connected in an operative manner relative to the hydraulic expander wherein the Joule-Thomson valve is closed during normal operation of the facility so as to render it inoperative and the entire flow of liquid natural gas passes through the hydraulic expander, and in which the Joule-Thomson valve is rendered operative in an opened flow-through condition during periods when the hydraulic expander is shut down or inoperative to facilitate the continuous and uninterrupted operation of the liquid natural gas production facility, albeit at a somewhat lower degree of efficiency, without necessitating any shutdown of the system.

Accordingly, it is a primary object of the present invention to provide an arrangement for the production of liquid natural gas wherein work is extracted through a hydraulic expander from a flow of the liquid natural gas prior to the flashing thereof to increase the yield of the liquid natural gas.

Another object of the present invention is to provide for an arrangement for production of liquid natural gas wherein work is extracted from a flow of the liquid natural gas through the intermediary of a hydraulic expander at extremely low temperatures so as to produce an effluent which, when flashed to effectuate the separation of the effluent into vapor and liquid flows in a low-pressure flash will appreciably reduce the amount of vapor or flash gas and enhance the yield of liquid natural gas while, concurrently, reducing the amount of energy required.

Still another object of the present invention is to provide a method for the more efficient production of liquid natural gas wherein the work is extracted to produce an effluent which, when flashed, results in an enhanced yield of liquid natural gas.

A more specific object resides in the provision of a method as described herein in which an effluent received from a hydraulic expander through which liquid natural gas conducted from a liquid natural gas manufacturing facility, is separated into vapor and liquid natural gas flows in a low-pressure flash with a higher yield in liquid proportion of the components, and in which the separated vapor may be economically utilized as fuel.

BRIEF DESCRIPTION OF THE DRAWINGS

Reference may now be had to the following detailed description of an exemplary embodiment of a liquid natural gas production system incorporating a hydraulic expander pursuant to the invention, taken in conjunction with the single FIGURE of the drawing illustrative of a schematic flow diagram of a stream of liquid natural gas conveyed from the main exchanger of a typical liquid natural gas manufacturing facility through the hydraulic expander.

DETAILED DESCRIPTION

Referring now in detail to the single FIGURE of drawing, there is illustrated an arrangement 10 for an increase in production of liquid natural gas and for the conservation of energy and reduction of flash gas in a liquid natural gas manufacturing installation.

The arrangement 10 includes a feed conduit 12 leading from the main exchanger (not shown) of a typical liquid natural gas manufacturing facility, as is well known in the technology.

The conduit 12, which conveys the liquid natural gas output from the liquid natural gas manufacturing facility connects into a hydraulic expander 14. The hydraulic expander may consist of a commercially available turboexpander, as heretofore commonly utilized in industry for let-down turbines, the treatment of gases, or in connection with water-based systems. In the inventive application, the hydraulic expander 14 is employed for the purpose of extracting work from the liquid natural gas so as to produce an effluent which is predominantly liquid natural gas and which is then conveyed into the conduit 16. Typically, the system operates at extremely low temperatures, the liquid natural gas in the conduit 12 being, for example, at a temperature of −225° F. and at a pressure of 535 psia upstream of the hydraulic expander, while subsequent to passing through the hydraulic expander, in the conduit 16 downstream of the hydraulic expander the temperature of the effluent may be found to be at −251° F. and at a pressure of 19 psia.

The effluent in conduit 16 is conducted into a low-pressure flash unit 18 in which the vapor or flash gas is separated out and conducted into a conduit 20, whereas the separate liquid natural gas is conducted into a conduit 22 from which it is pumped into a liquid natural gas storage tank (not shown) through the intermediary of a suitable transfer pump 24.

The flash gas or vapor in the conduit 20 exiting from the low-pressure flash unit 18 may be utilized as fuel for driving other components within the facility, or may simply be torched if it is not needed for any purpose.

The hydraulic expander 14 which, as indicated hereinabove, may be a commercial type of turboexpander, may be shaft-coupled to suitable compressors, pumps or generators, enabling the work extracted from the liquid natural gas by the hydraulic expander to be converted into usable mechanical and/or electrical energy, thereby resulting in a considerable energy saving to the overall system.

In the embodiment of the arrangement 10 as illustrated herein, a conduit 26 connects into the conduits 12 and 16 in a parallel bypass flow relationship with respect to the hydraulic expander 14. Interposed in the conduit 26 is a Joule-Thomson valve 28, as is currently known in the technology. During normal operation of the hydraulic expander 14 the Joule-Thompson valve is in a normally closed position so as to preclude the flow of any liquid natural gas through the conduit 26; in essence, causing the entire flow of liquid natural gas from the manufacturing facility to flow through the hydraulic expander.

As illustrated hereinbelow in Table I, there is set forth the operation of the arrangement 10 employing the hydraulic expander 14 for a typical flow of liquid natural gas fed from a liquid natural gas manufacturing facility.

TABLE I

| Liquid Natural Gas Component | Feed Stream (Conduits 12 & 16) Moles | Vapor (Conduit 20) Moles | Liquid (Conduit 22) Moles |
|---|---|---|---|
| Nitrogen | 0.43 | 0.31 | 0.12 |
| Methane | 88.75 | 8.98 | 79.77 |
| Ethane | 6.72 | | 6.72 |
| Propane | 3.11 | | 3.11 |
| Iso Butane | 0.46 | | 0.46 |
| Normal Butane | 0.47 | | 0.47 |
| Iso Pentane | 0.04 | | 0.04 |
| Normal Pentane | 0.02 | | 0.02 |
| Total | 100.00 | 9.29 | 90.71 |

As tabulated in Table I, in an arrangement employing the hydraulic expander 14, the feed stream conducted into conduit 12 from the main exchanger of the liquid natural gas (LNG) manufacturing facility is separated upon flashing in unit 18 into flash gas or vapor conveyed into conduit 20, and liquid natural gas conveyed into conduit 22, indicative that of initially 100 moles fed, 90.71 moles are obtained as liquid natural gas which is pumped to the liquid natural gas storage through the transfer pump 24, whereas 9.29 moles are present as vapor or flash gas.

In contrast therewith, Table II, as set forth hereinbelow, illustrates the production of liquid natural gas relative to the amounts of flash gas or vapor obtained when the arrangement 10 conveys the flow through the Joule-Thomson valve 28 in lieu of the hydraulic expander 14.

TABLE II

| Liquid Natural Gas Component | Feed Stream (Conduits 12, 26 28, 16) Moles | Vapor (Conduit 20) Moles | Liquid (Conduit 22) Moles |
|---|---|---|---|
| Nitrogen | 0.43 | 0.32 | 0.11 |
| Methane | 88.75 | 8.44 | 79.31 |
| Ethane | 6.72 | | 6.72 |
| Propane | 3.11 | | 3.11 |
| Iso Butane | 0.46 | | 0.46 |
| Normal Butane | 0.47 | | 0.47 |
| Iso Pentane | 0.04 | | 0.04 |
| Normal Pentane | 0.02 | | 0.02 |
| Total | 100.00 | 9.76 | 90.24 |

In this instance, with the feed stream of liquid natural gas in conduit 12 being identical in composition, the vapor of flash gas conducted into conduit 20 from the low-pressure flash 18 consists of 9.76 moles, whereas the liquid natural gas conducted to the storage through conduit 22 and transfer pump 24 consists of 90.24 moles for each 100 moles of fed liquid natural gas from the manufacturing facility.

Consequently, when the arrangement 10 utilizes the hydraulic expander 14 in lieu of the Joule-Thomson valve 28, 90.71/90.24=1.005 times more liquid natural gas is produced after flashing in the flash unit 18. This also results in a lower vapor production by the hydraulic expander which is (9.76–9.29/9.76)×100=4.816% lower than that obtained with the Joule-Thomson valve.

From the foregoing it becomes quite readily apparent to one skilled in the technology that through the intermediary of employing, in a unique manner, a hydraulic expander 14 in the arrangement 10 in lieu of the commonly utilized Joule-Thomson valve 28, there is obtained a higher yield of liquid natural gas with a concurrent reduction in vapor or flash gas, and with more usable energy being available through work recovered by means of the hydraulic expander, thereby rendering the entire liquid natural gas production system more economical in operation.

The utilization of the Joule-Thomson valve in the system in a flow bypass relationship with the hydraulic expander will ensure that during periods when the hydraulic expander is inoperative, such as during repairs or replacements, the arrangement may continue operation without any down-time being encountered although, temporarily, at a reduced efficiency in the output or yield of liquid natural gas.

While there has been shown and described what is considered to be a preferred embodiment of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. In a liquid natural gas manufacturing facility, an arrangement for improving liquid natural gas production, reducing flash gas production and conserving energy, comprising:

means operating to reduce the pressure of a super-cooled stream of liquid natural gas feed from a main exchanger of the liquid natural gas manufacturing facility, to extract work from both a liquid phase and a vapor phase formed during the reduction in pressure, and to separate the liquid and vapor phases into streams of liquid natural gas and flash gas;

said means consisting of a hydraulic expander designed to extract work from both the liquid phase and vapor phase formed during the reduction in pressure, a low pressure flash means for separating the liquid and vapor phases, and a first flow conduit for feeding the super-cooled stream of liquid natural gas from the main exchanger to the hydraulic expander and for feeding the liquid and vapor phases exiting from an outlet of the hydraulic expander directly to an inlet of the low pressure flash means.

2. An arrangement as claimed in claim 1, further comprising:

means to enable the liquid natural gas manufacturing facility to be continuously operated without interruption when the hydraulic expander is out of service;

said means consisting of a second flow conduit connecting into said first flow conduit upstream and downstream of said hydraulic expander to form a parallel bypass flowpath for the liquid natural gas stream between the main exchanger and the low pressure flash means, and a Joule-Thomson valve interposed in said second flow conduit, said Joule-Thomson valve being selectively closable to preclude flow of liquid natural gas when the hydraulic expander is in service and openable to allow flow of liquid natural gas and effect a reduction in the pressure of the gas when the hydraulic expander is out of service.

3. An arrangement as claimed in claim 1, said hydraulic expander comprising a turboexpander.

4. An arrangement as claimed in claim 1, said hydraulic expander being connected to means for converting the work extracted from the liquid and vapor phases into mechanical or electrical energy.

5. An arrangement as claimed in claim 1, said stream of flash gas formed in the flash means being employable as fuel in said manufacturing facility.

6. In a method for producing liquified natural gas, a method for improving liquid natural gas production, reducing flash gas production and conserving energy, comprising:

feeding a stream of super-cooled and pressurized liquid natural gas from a main exchanger of a liquid natural gas manufacturing facility to a hydraulic expander means;

conducting the stream through the hydraulic expander to reduce the pressure of the stream and to further cool the stream, said stream forming gas and vapor phases during the pressure reduction;

extracting work from both the liquid and vapor phases during the pressure reduction by means of said hydraulic expander;

feeding the liquid and vapor phases from an outlet of the hydraulic expander directly to a low-pressure flash means without further treatment; and flashing the liquid and vapor phases in the low pressure flash means in order to form separate streams of liquid natural gas and flash gas.

7. A method as claimed in claim 6, further comprising providing a parallel flow path for the liquid natural gas stream between the main exchanger and the flash means bypassing said hydraulic expander, and a Joule-Thomson valve interposed in said second flow path, said Joule-Thomson valve being selectively closable to preclude flow of liquid natural gas when the hydraulic expander is in service and openable to allow flow of liquid natural gas and effect a reduction in the pressure of the gas when the hydraulic expander is out of service, thereby enabling the liquid natural gas manufacturing facility to be continuously operated without interruption when the hydraulic expander is out of service.

8. A method as claimed in claim 6, said hydraulic expander comprising a turboexpander.

9. A method as claimed in claim 6, further comprising connecting said hydraulic expander to means for converting the work extracted from the liquid and vapor phases into mechanical or electrical energy.

10. A method as claimed in claim 6, further comprising employing the stream of flash gas formed in the low pressure flash means as fuel in the manufacturing facility.

* * * * *